United States Patent [19]

Lockwood

[11] Patent Number: 4,658,549

[45] Date of Patent: Apr. 21, 1987

[54] DRILL BIT SHARPENING DEVICE

[76] Inventor: David N. Lockwood, 6191 Ewart Street, Burnaby, British Columbia, Canada, V5J 2X4

[21] Appl. No.: 826,061

[22] Filed: Jan. 21, 1986

Related U.S. Application Data

[63] Continuation-in-part of Ser. No. 752,027, Jul. 5, 1985.

[51] Int. Cl.[4] ..... B24B 3/00

[52] U.S. Cl. ..... 51/94 R; 51/219 R

[58] Field of Search ..... 51/91 R, 92 R, 94 R, 51/96, 219 R, 218 R, 218 A

[56] References Cited

U.S. PATENT DOCUMENTS 4,059,928 11/1977 Marchitello ..... 51/219 R

*Primary Examiner*—Robert P. Olszewski
*Assistant Examiner*—Maurina Rachuba
*Attorney, Agent, or Firm*—Fetherstonhaugh & Co.

[57] ABSTRACT

A sharpening device, particularly useful for sharpening tools having two identical cutting edges such as drill bits, comprised of a jig for holding a drill bit used with an adjustable support having a rotatable grindstone and a pivot arm retaining means. The jig has a clamp means for releasably retaining a tool or drill bit in it, and a frame. The frame is connected to the clamp means, and typically carries first and second pivot arms which are symmetrically disposed at an angle to the clamp axis. The first pivot arm is placed in the pivot arm retaining means of the support where the jig can rest in a first rest position in which the clamp axis extends forwardly to intersect a grinding face of a grindstone carried in the support, at a predetermined lateral angle of $A_1$ thereto. In addition, by inverting the jig, it can rest on the support, in a second rest position inverted from the first position, in which the second pivot arm rests in the pivot arm retaining means, with the clamp axis extending forwardly to intersect the same grindstone grinding face at an equal lateral angle of $A_2$ and at the same intersection point on the clamp axis. Thus, tools such as drill bits, can have each of their cutting edges accurately and identically sharpened, with the points centered and the cutting edges of the same length and angle accurately obtained during sharpening, basically by simply inverting the jig holding the bit.

24 Claims, 14 Drawing Figures

DRILL BIT SHARPENING DEVICE

This application is a continuation-in-part of application Ser. No. 752,027 filed July 5, 1985.

FIELD OF THE INVENTION

This invention relates to a device for sharpening tools, in particular for sharpening a typical drill bit.

DESCRIPTION OF THE PRIOR ART

A typical twist drill bit, or simply referred to as a "drill bit" in this application, has a point with two identical cutting edges, which when viewed on a plane perpendicular to the drill bit axis, are spaced apart 180° (degrees). These cutting edges in addition are each angled backward at respective angles $A_1$ and $A_2$, which on a typical drill bit are each 59° to the drill bit axis. In addition, the material behind each cutting edge of the drill bit tip, is sloped back at an angle which on a typical bit, is fixed at between 8° to 12° adjacent the cutting edge, on a convex surface having an arc typically of about 0.7 inches radius.

When a drill bit becomes worn, and it is desired to resharpen it, it will be seen that if the bit is to function properly, all of the original parameters mentioned above, must be obtained. It is of course difficult to accurately obtain the above parameters, simply by sharpening the tip on a grindstone, by hand. To facilitate sharpening, clamping devices have been developed, for use with a rotating grindstone. Such clamping devices typically require the use of micrometers or other fine adjustments, in order to ensure that the accuracy of the parameters mentioned above can be obtained during the sharpening operation against a grindstone face. In addition, even with such fine adjusting mechanisms, often it is difficult to obtain accurate positioning of the drill bit for some parameters. For example, generally no accurate means are provided for ensuring that the cutting edges of the tip, will be spaced 180° apart on a plane normal to the bit axis and will be of equal angle and length. In addition, such devices tend to be relatively complex in construction, in particular in the provision of fine adjusting mechanisms for the positioning of the drill bit, and hence relatively expensive to manufacture, as well as relatively tedious to use.

It is desirable then, to have a sharpening device, particularly which will sharpen drill bits, which will be relatively simple to construct, while still allowing all of the original parameters to be obtained in the resharpened bit, while at the same time being relatively simple to use.

SUMMARY OF THE INVENTION

A drill bit sharpening device is provided, for use with a support carrying a rotatable grindstone, and which support further has a pivot arm retaining means. The device has a drill bit jig with clamp means and a frame extending therefrom, and connected thereto. The clamp means can releasably retain a drill bit in it, the axis of which coincides with the clamp axis and extends forward from the clamp means along the clamp axis. The frame has two jig pivot arms such that the jig can rest in a first rest position with the first jig pivot arm resting in the jig pivot arm retaining means of the support, and with the clamp axis extending forwardly to intersect a grinding face of a grindstone carried in the support at an angle of $A_1$ to the grindstone face. The second jig pivot arm is arranged such that the jig can rest in a second rest position, inverted from the first position, and in which the second rest position the second jig pivot arm rests in the pivot arm retaining means of the support, the clamp axis in such position extending forwardly to intersect the same grinding face of the grindstone at an equal angle $A_2$ and at the same intersection point on the clamp axis.

In addition, the two pivot arms are symmetrically located and 180° apart with respect to the clamp axis (drill bit axis) so that the point of intersection between the clamp axis (drill bit axis) and the grindstone face is identical when either of the two pivot arms is placed in the pivot arm retaining means. This ensures that both faces of the drill bit are identical after sharpening, that is: the two cutting edges intersect at a point on the drill bit axis and are of the same length and angle.

Further preferably, the jig pivot arms allow the jig to pivot about a jig pivot axis in a vertical direction perpendicular to the clamp axis, when the jig is in the first or second rest position. By the jig pivoting about the jig pivot axis, as referred to throughout this application, is meant that the jig pivots relative to the support. This arrangement allows obtaining of the required backsweep arc of the material behind the cutting edge a drill bit.

In addition, the pivot arm retaining means is set parallel to the face of the grindstone being used. When the jig is in the first or second rest position the jig can be translated in a sideways direction at the same time as being pivoted in a vertical direction. This arrangement allows all different sections of the grindstone face to be utilized which keeps the grindstone face smooth and square.

The frame may usefully have knife edges for the first and second arms, which are retained by notches which provide the pivot retaining means of the support. In addition, the clamp means may preferably be comprised of two opposed jaws, each attached to a corresponding arm. These jaws are arranged to be moveable toward and away from one another while moving their respective arms with them. By such an arrangement, the jaws can accommodate different diameter drill bits between them, while maintaining an identical relationship between the clamp axis and the first and second pivot arm axes. The jaws must be so constructed that the axis of the drill bit coincides with the axis of jaws (i.e. the "clamp axis") for any size of drill bit. A jaw adjuster is also provided in such case, which is connected to the jaws so as to urge them toward and away from one another.

In another embodiment of the invention, each of the jig pivot arms is pivotable sideways with respect to its corresponding jaw. By such means, the angles between the first line and the clamp axis, and between the second line and the clamp axis can be altered to any of plurality of equal but opposite values. Such an arrangement allows sharpening of drill bits with differing values of the angles $A_1$ and $A_2$ (although such are still equal).

The sharpening device can also include the support, which can usefully be provided with a grindstone mount to rotatably support a circular grindstone at a grindstone axis, which grindstone axis may usefully be laterally spaced from and parallel to the jig pivot axis. By such means, a drill bit held in the clamp means can have its cutting edges sharpened at the equal angles $A_1$ and $A_2$ to the clamp axis, and the material behind its cutting edge sloped rearward from the cutting edge in a backsweep arc simply by pivoting the jig in the vertical direction in the first or second rest position in the support.

Preferably the jig pivot arms and support retaining means are disposed so that the angles $A_1$, and $A_2$ are 59°. In addition, the vertical distance between the jig pivot axis and the clamp axis is preferably such that the material behind each cutting edge of a drill bit held in the clamp means, can be cut in a rearward convex slope varying from substantially 8° to 12° at the cutting edge. The lateral separation between the grindstone axis and the jig pivot axis is preferably such that the foregoing material can be cut in a rearward arc of substantially 0.7 inches, by pivoting the frame in the vertical direction about the jig pivot axis. The radius of the convex backslope can be adjusted by changing the distance between the axis of rotation of the jig and the face of the grindstone, either by providing movable pivot retaining means on the support or providing a method of adjusting the axis of the rotatable grindstone.

In a preferred form of the invention, the pivot action is provided by a round shaft connected to each of the jaws which is inserted into a pivot arm retaining sleeve disposed on the grindstone mount so that a drill bit face makes contact with the grindstone surface. Similarly, the jig may be inverted and the second shaft sufficiently inserted into the sleeve to sharpen the second face of the drill bit.

DRAWINGS

Embodiments of the invention will now be described with reference to the drawings in which.

DESCRIPTION OF THE PREFERRED EMBODIMENTS

Prior to describing the embodiments of the invention shown in the Figures, it should be noted that the terms "upward", "downward", "sideways", and similar terms, are used in a relative, rather than absolute sense. Such terms are absolute only with reference to a typical position in which the device of the present invention might be used.

Figure 1:
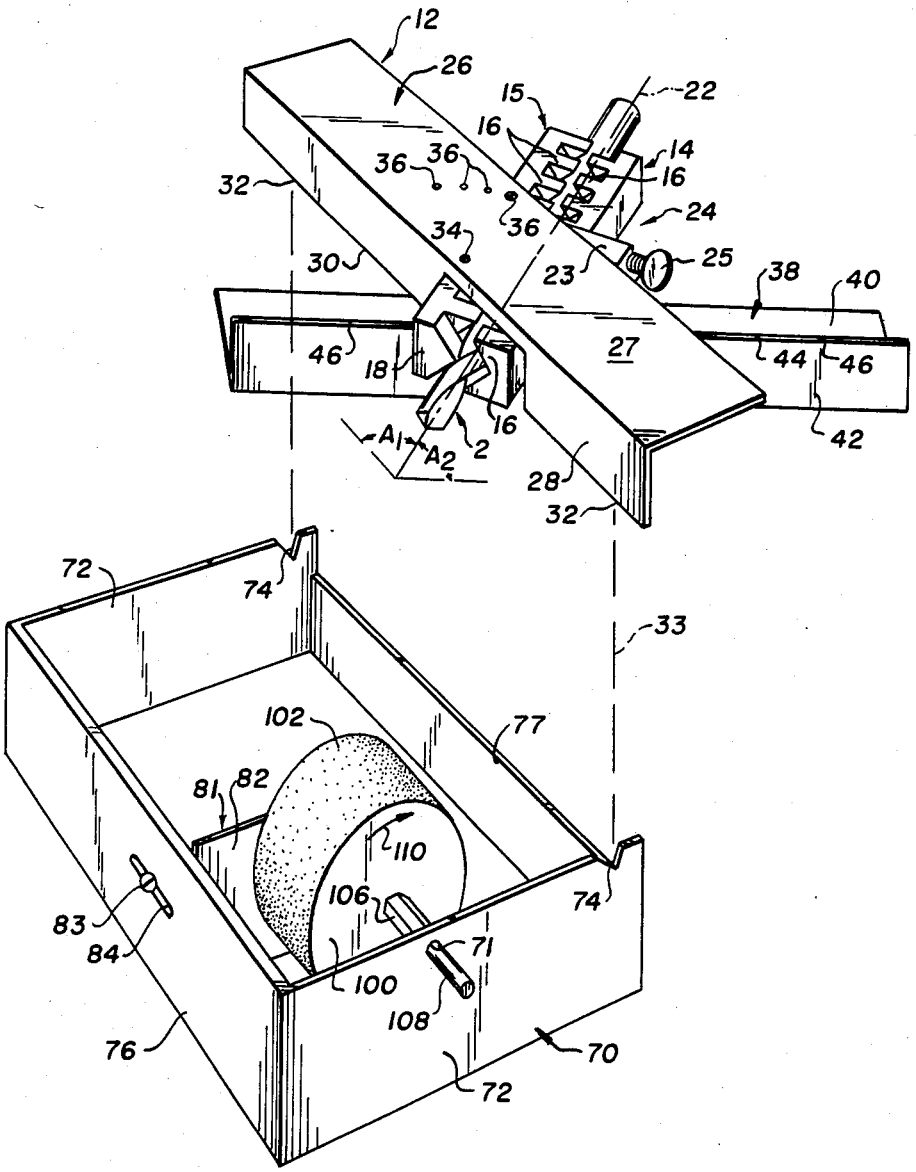
FIG. 1 is a perspective view of an embodiment of a drill bit sharpening device of the present invention.
Figure 2:
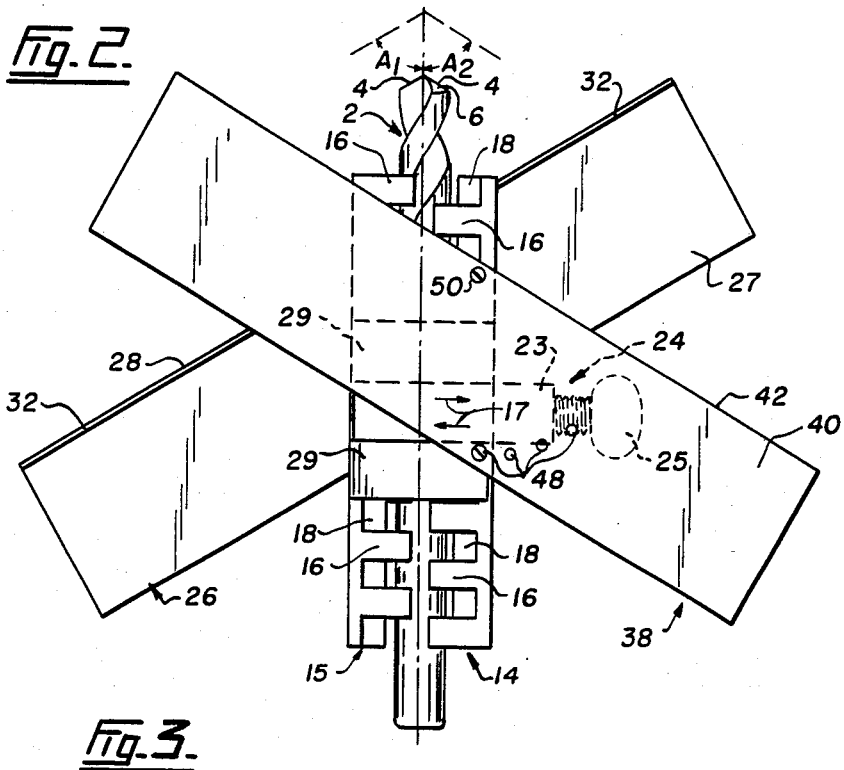
FIG. 2 is a bottom plan view of the jig of the device of FIG. 1.
Figure 3:
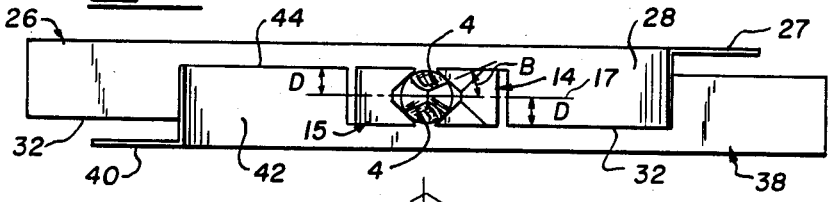
FIG. 3 is a front elevation view thereof.
Figure 4:
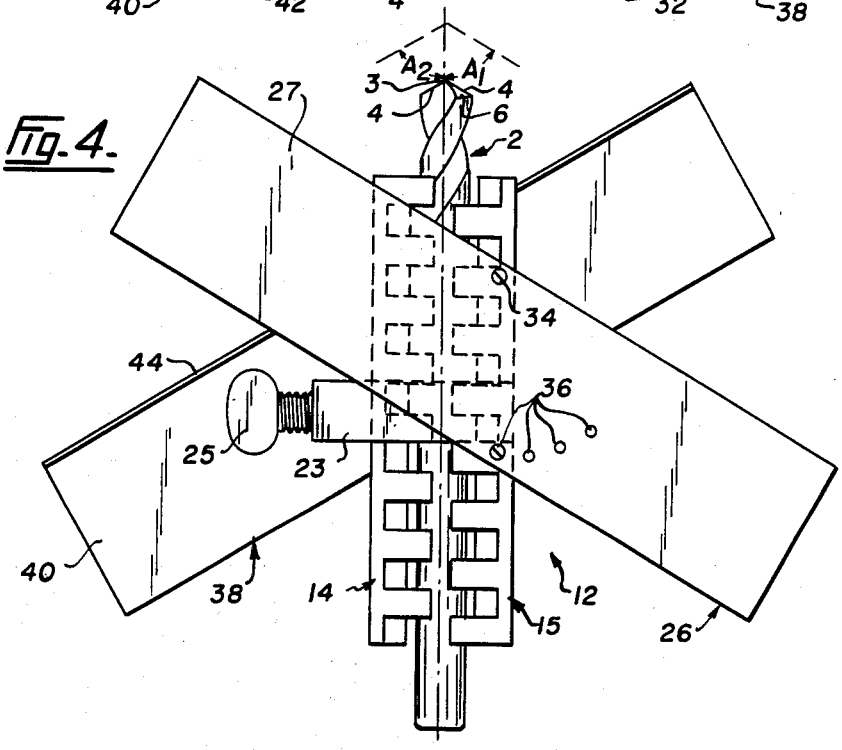
FIG. 4 is a top plan view thereof.
Figure 12:
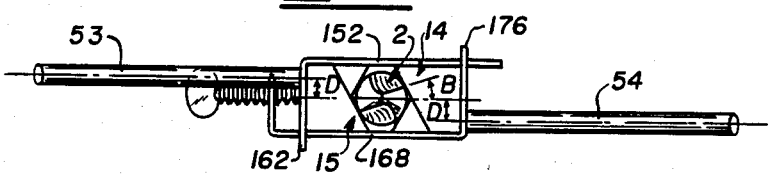
FIG. 12 is a front elevation view thereof.

Referring to the embodiment of the invention as shown in FIGS. 1–4 first, the device shown in those figures consists of a jig 12, and a support 70, which are not attached to one another, but are typically used in conjunction with one another. The jig 12 has two elongated, opposed jaws 14, 15, each carrying alternate sets of meshing teeth 16, 18. The teeth 16 have angular recesses therein pointing away from a clamp axis 22, while teeth 18 point inward to clamp axis 22. Jaws 14 and 15 are aligned such that when a drill bit 2 is held therebetween, the axis of the drill bit 2 will coincide with clamp axis 22, as clearly shown in FIG. 1. The shape of teeth 16 and 18, and their alternating arrangement across the jaws (as best shown in FIGS. 2, 3 and 12), ensures that even when smaller drill bits are utilized, that the two axes will coincide. Jaws 14 and 15 can be urged toward or away from one another in the direction of arrows 17, so as to retain a drill bit 2 therebetween, by means of a jaw adjuster 24. Jaw adjuster 24 consists of a bracket 23 having an upper and lower flanges, which extend over jaw 14, and are connected to jaw 15, by means of welding or the like, and aligned by guides 29 connected to jaw 14, as for example shown in FIG. 2. Jaw adjuster 24 also has a bolt 25 which is threaded through bracket 23, and has one end rotatably mounted in jaw 14, in a manner similar to that shown in FIG. 9 in connection with the embodiment of FIGS. 6–8, as will be described later.

The frame of the jig consists of a first arm 26, and a second arm 38. Arm 26 has an upper panel 27, and a side panel 28, the lower edge 30 of which acts as a knife edge. A set of points 32 have been identified on knife edge 30, which set can act as a first set of jig bearing points 32. It will also be appreciated, that as knife edge 30 is linear, many sets of points along knife edge 30 can act as the first set of jig bearing points. As knife edge 30 is on side panel 28, directed downward from the remainder of arm 26, the first set of jig bearing points 32 can be regarded as being directed downward. An opening 34 in surface 27, allows the first arm 26 to be connected by means of a screw or the like, to jaw 15, while any one of a plurality of openings 36, also allow arm 26 to be connected to jaw 15. It will be noted that openings 36 are arranged in an arc, so that arm 26 can be pivoted sideways about opening 34, with respect to its corresponding attached jaw 15, and a screw inserted through any of the openings 36, so as to alter the angle between the knife edge 30 and clamp axis 22.

Second arm 38, is identical to first arm 26, but is inverted with respect to first arm 26. Thus, second arm 38, has a lower panel 40, and an upwardly extending side panel 42. However, jig 12, could easily be inverted from the position shown in FIG. 1, and thus again the terms "lower" and "upper" are not absolute terms. An upper edge 44 of side surface 42 likewise acts as a knife edge, with a set of points, such as points 46, acting as a second set of jig bearing points, which may be regarded as upwardly directed. Second arm 38 is attached to its corresponding jaw 14 so as to move with jaw 14 when moved toward or away from opposed jaw 15, by means of a screw passing through an opening 50, and a screw passing through one of a plurality of openings 48. It will be appreciated that opening 48 on second arm 38, correspond to openings 36 on first arm 26, and are for the same purpose, namely to allow second arm 38 to pivot sideways about opening 50, with respect to corresponding jaw 14, and be retained in any of a plurality of angular positions, corresponding to any of the openings 48. Given that arms 26 and 38 are identical in construction, including the spacing of openings 36 and 48, it can then be said that the angles between the first line extending between points 32, and clamp axis 22, and the angle between the second line extending between point 46 and clamp axis 22, can be releasably fixed in any of a plurality of equal, but opposite values, simply by removing the screw in an opening 48 or 36, and pivoting second arm 38 and first arm 26, about their respective openings 50, 34, to positions where a screw can pass through an opening 36, and another screw through corresponding opening 48.

In order to obtain the backsweep curve and angle there must be a vertical separation between the jig pivot axis and the clamp axis 22. For example, the jig pivot axis may be set at a vertical distance 0.1 inches below clamp axis 22 (distance D in FIGS. 3 and 12). Such a distance will allow the material behind cutting edges 4 of a drill bit to be sloped rearward from the cutting edge at an angle of about 8° when the jig pivot axis is 0.7 inches from a face 102 of grindstone 100, and sloped backward about 12° when the pivot axis is 0.5 inches from the face 102 of grindstone 100. (See FIGS. 1A and 5A) This also allows the appropriate convex arc of about 0.7 inches radius to be obtained on such material on a drill bit point 3.

Another method of varying the backsweep angle is to change the angle of the cutting edge 4 (angle B in FIGS. 3 and 12) when viewed perpendicular to the axis 22 of the drill bit. FIGS. 3 and 12 also demonstrate how the jig pivot axes are disposed at 180° to each other and are vertically offset a distance D from the drill bit axis.

Figure 1A:
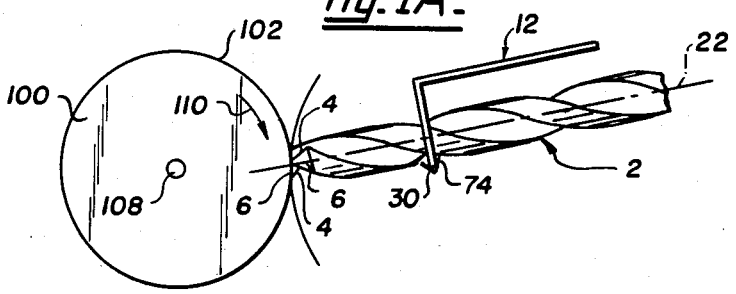
FIG. 1A is a side elevation showing a portion of the device in FIG. 1 being used to sharpen a drill bit.

Referring now to support 70, such support has opposed sides 72, each with a downwardly extending notch 74 on forward ends thereof, a rear side 76 with a sideways extending slot 84 therein, and a front panel 77 which is lower in height than side panels 72. Notches 74, as shown in FIG. 1, are spaced apart a distance equal to that of the first set of jig bearing points 32, and the second set of jig bearing points 46. It will be appreciated though, because of the linear nature of knife edges 30 and 44, that side panels 72 on support 70, and corresponding notches 74, could be spaced closer together or further apart, than shown in FIG. 1. When jig 12 is lowered along the broken lines 33 as indicated in FIG. 1, so that the first set of jig bearings points 32, rests in notches 74 (i.e. support bearing points 74), jig 12 can then be said to be in a first rest position. If jig 12 was inverted (i.e. flipped over 180°) from the position shown in FIG. 1, so that the second set of jig bearings points 46 rest in notches 74, then such would be a second rest position of jig 12. It will be appreciated that when jig 12 is in either the first or second rest position as described, due to the dimensioning of notches 74 and the linear nature of the first or second set of jig bearing points 32, 46, jig 12 is prevented from pivoting sideways.

Support 70 is provided with an outboard grindstone mount 81, to support a circular grindstone 100. The entire grindstone mount includes outboard mount 81 and an opening 71 in a side panel 72. Grindstone 100 would typically be of the double extended shaft variety, with one end protruding through an opening (not shown in the embodiment of FIG. 1) in panel 82 of outboard mount 81, and the other end protruding through opening 71 in side panel 72. Grindstone 100 is spaced apart from side panel 72 and panel 82, by virtue of spacers 106 (only one being shown in FIG. 1). Outboard mount 81 can be adjusted toward and away from grindstone 100, to allow it to be removed. It will be noted that jig 12 can pivot upward or downward about an axis lying along a line extending between notches 74 on support 70, which line can be referred to as a jig pivot axis. The jig pivot axis is parallel to, but laterally spaced from a grindstone axis upon which shaft 108 of grindstone 100 lies, and about which grindstone 100 can rotate.

In order to use the sharpening device of the embodiments of FIGS. 1 to 4, jaws 14, 15, are moved apart under the influence of bolt 25, a sufficient distance to insert a drill bit 2 therebetween. Bolt 25 is then tightened to urge jaws 14, 15 toward one another so as to releasably retain drill bit 2 therebetween. The drill bit 2 shown in the drawings, is a typical drill bit having a point 3, with two cutting edges 4 disposed 180° apart on a plane perpendicular to clamp axis 22. The material behind cutting edges 4 includes respective faces 6, which are sloped rearward at an angle which can typically be from 8° to 12° at the cutting edges 4, and in a convex arc of a radius of approximately 0.7 inches.

Jig 12 can then be placed in the first rest position as already described, in which position clamp axis 22 (along which the axis of bit 2 lies), will be disposed at a lateral angle $A_1$ to grindstone face 102. Typically, jig 12 will be initially placed in a position such that point 3 of drill bit 2 is disposed below and out of contact with face 102. A typical power hand drill or drill press can then be used to drive shaft 108 and hence grindstone 100, in the direction of arrow 110. Jig 12 is then pivoted upwardly about the jig pivot axis (that is upwardly about notches 74), so that point 3 gradually contacts, then rises above grindstone face 102. This will result in the necessary angles of the face 6 and cutting edge 4 being obtained, and the required rearward slope of face 6 being obtained (as best shown in FIG. 5A). If required though, the foregoing steps can be repeated. In order to sharpen the other cutting edge 4, jig 12 is inverted such that the second set of jig bearing points 46 rests in the notches 74 (i.e. jig 12 is in the second rest position). The foregoing sharpening procedure is then repeated. Thus, it will be seen that the required angles $A_1$ and $A_2$, and the angles of the faces 6, are automatically obtained by the device described during sharpening of the bit. In particular, it will be seen that cutting edges 4 are 180° apart as required and of equal length, this angle and length being obtained simply be inverting jig 12. Thus, highly accurate sharpening of one cutting edge 4 and its corresponding face 6, of a drill bit 2 is obtained with only one simple initial adjustment, namely simply placing bit 2 in jig 12 such that point 3 thereof is sufficiently close to grinding face 102 to be sharpened. The other cutting edge 4 and its corresponding face 6, are also sharpened accurately simply by inverting jig 12, without the need for tedious adjustment of micrometer controls or the like.

Figure 5:
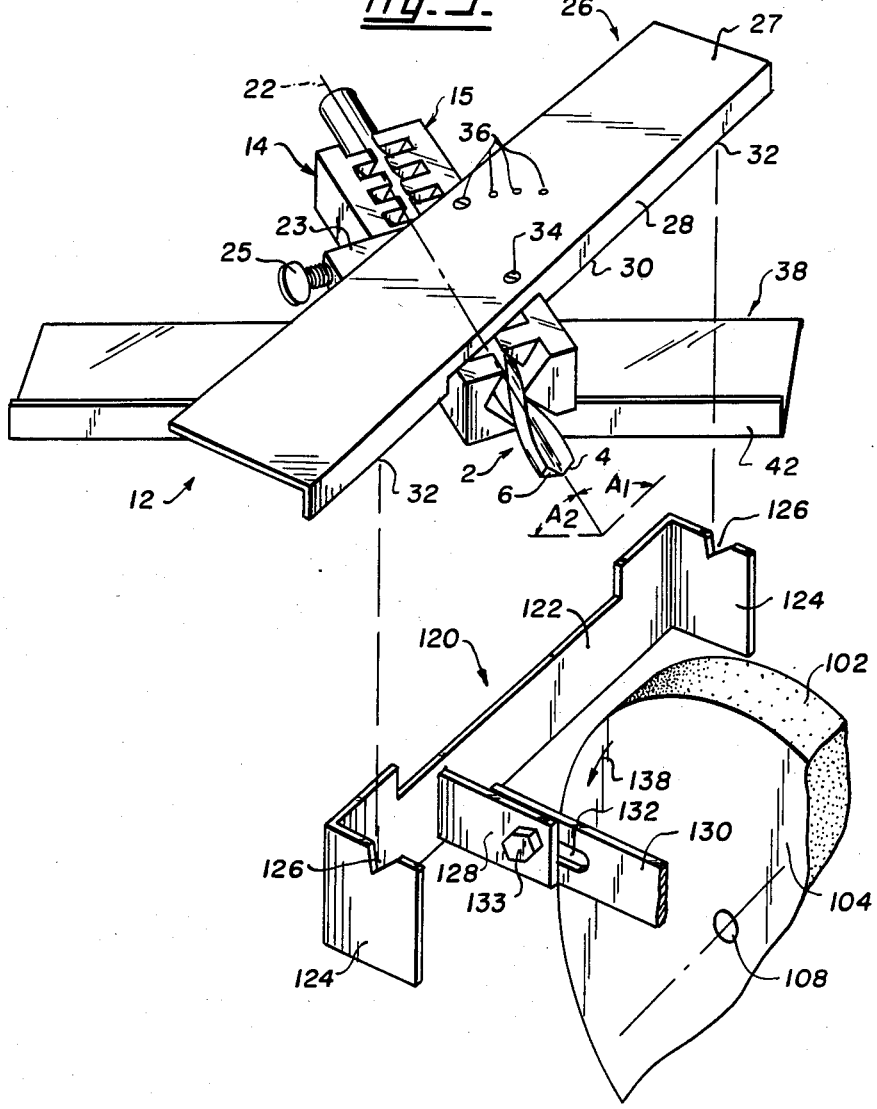
FIG. 5 is a perspective view of an alternate embodiment of the drill bit sharpening device of the present invention.
Figure 5A:
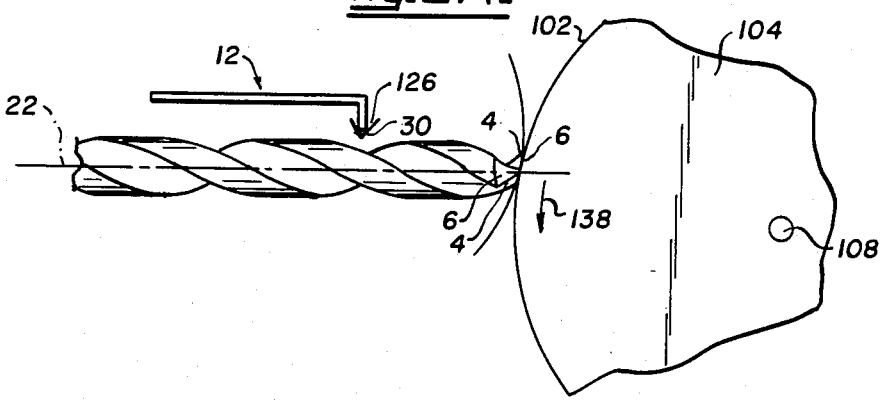
FIG. 5A is a side elevation, similar to FIG. 1A, but showing a portion of the device of FIG. 5 being used to sharpen a drill bit.

The embodiment of the cutting device shown in FIG. 5, is very similar to that shown in FIGS. 1–4, and analogous parts have been numbered the same. The difference between the embodiment of FIG. 5 and that of FIGS. 1–4, is simply that in the case of the former, a standard work shop grinder, is utilized. The grindstone 104 of the grinder has an axis of rotation 108, and is connected to a support 120 through an arm 130 fixed to the grindstone supporting frame (not shown). Support 120 has a front panel 122, and two side tabs 124, carrying notches 126. It will be seen that the foregoing part of support 120 is essentially the same as front panel 77, and notches 74, of support 70 of the embodiment of FIGS. 1–4. An extension 128 allows support 120 to be connected to arm 130 through means of a bolt 134 and associated nut, which bolt can extend through a slot 132 in arm 130. By virtue of slot 132, the distance between a jig pivot axis (defined by a line extending between notches 126) can be adjusted. The lateral separation of the jig pivot axis, and the curved face 102 of grindstone 104, will of course be determined by the location at which arm 130 is connected to the support of grindstone 104. In this embodiment also, since a typical grindstone found in a machine shop will rotate in the direction of arrow 138 (i.e. in the opposite direction of grindstone 100 as shown in FIG. 1), jig 12 of the embodiment of FIG. 5, must be constructed as a mirror image of jig 12 in the embodiment of FIGS. 1–4 (that is a mirror image in the sideways direction) except that the jig pivot axis is placed 0.1 inches above the clamp axis 22, rather than 0.1 inches below. The use of the embodiment of FIG. 5, will of course be essentially the same as described in connection with the embodiment of FIGS. 1–4.

Figure 6:
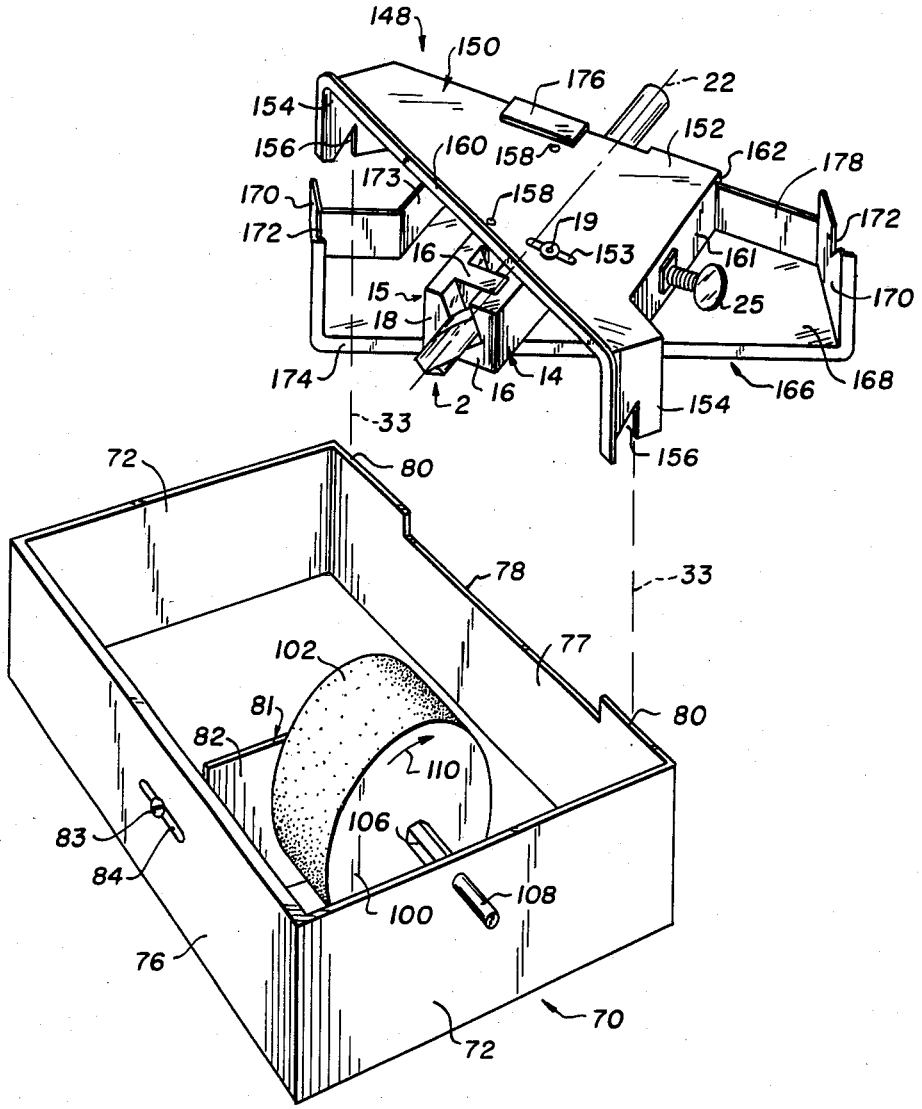
FIG. 6 is a perspective view of another embodiment of the sharpening device.
Figure 7:
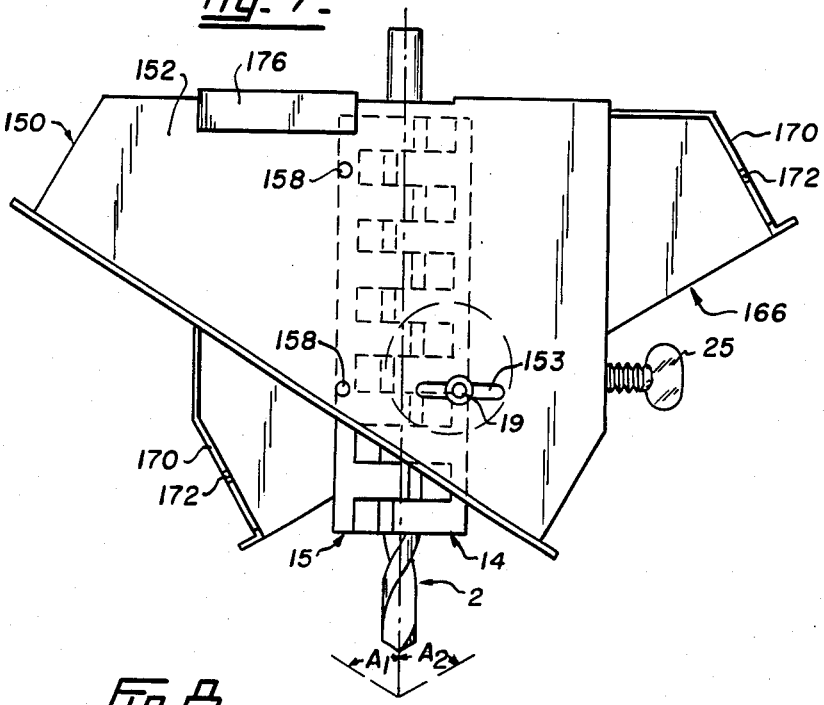
FIG. 7 is a top plan view of the jig of the embodiment of FIG. 6.
Figure 8:
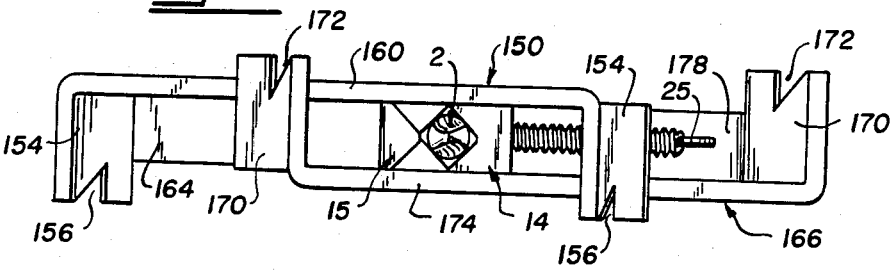
FIG. 8 is a front elevation thereof.
Figure 9:
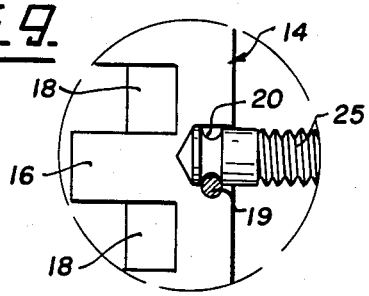
FIG. 9 is an enlarged view of a portion of a jaw adjusting mechanism of the embodiment of FIG. 6.

Referring now to FIGS. 6–8, the embodiment of the invention shown therein is essentially the same as that of FIGS. 1–4, with some minor changes, and similar parts have been numbered the same. In particular, the drill bit jig 148 is provided with first and second arms 150, 166, respectively, of a different shape than the arms of the embodiment shown in FIGS. 1–4. First arm 150 has an upper panel 152, and two downwardly extending tabs 154, which now carry the first set of jig bearing points, namely notches 156. In this case the jig bearing points are the apex of notches 156, rather than simply knife edges. First arm 150 is connected to jaw 15 by means of screws or rivets passing through openings 158 and has a side panel 161. In addition, a tab 162 of first arm 150 extends downwardly over and around a back panel 178 of second arm 166 and below a lower surface 168 of second arm 166, in a manner the same as a tab 176 of second arm 166 extends over and around a back panel 164 of first arm 150. Reinforcing ridges 160 and 174 are provided for a structural reinforcement of arms 150 and 166.

Second arm 166 is identically constructed to first arm 150, except it is disposed in an inverted position with respect thereto. Thus, second arm 166, includes a second set of notches 172 which act as jig bearing points, disposed on end tabs 170. In addition, second arm 166 has a side panel 173 the same as side panel 161 of the first arm 150.

An adjusting bolt 25 is provided in a manner similar to the embodiment of FIGS. 1–4, adjusting bolt 25 extending through a threaded portion on surface 161 of first arm 150. Adjusting bolt 25 is rotatably connected to jaw 14 by means of a groove 20 disposed at its forward end, which groove normally aligns with a screw or rivet 19 extending down through a bore in jaw 14. Screw 19 also passes through a slot 153 on first arm 150, which slot allows screw 19 to move in relation to first arm 150, as jaws 14 and 15 are moved toward or away from one another under the influence of turning of bolt 25.

An imaginary axis drawn between the apexes of notches 156 disposed at an angle to the clamp axis 22 will be equal but opposite the angle that any imaginery axis drawn between the apexes of notches 122 is disposed to clamp axis 22. The angle between each of these two imaginary axes and the drill bit axis are equal angles A1 and A2 and these two axes each vertically separated above and below the drill bit axis by the distance D.

Support 70 is again essentially the same as the support 70 of the embodiment of FIGS. 1–4. However, since the first set and second set of jig bearing points 156, 172 respectively, are in the form of notches, notches 74 which acted as the support bearing points in the embodiment of FIGS. 1–4, can be dispensed with. Instead, the upper knife edges of front panel 77 can act as the axis about which the jig 148 will pivot. In addition, a portion 78 of the upper edge of front panel 77 is lower than the remainder of the upper edge thereof, so that when drill bit jig 148 is in the first or second rest position, the second arm 166 or first arm 150, respectively, which is not in use at that time, can clear such lowered portion 78 of front panel 70.

It will be seen that the embodiment of FIGS. 6–8, is used in essentially the same manner as the embodiment of FIGS. 1–4. That is, the jig 148 can be placed in a first rest position, by lowering it along lines 33, from the position shown in FIG. 6, so that the first set of jig bearing points 156 rest upon the support bearing points 80. In addition, the jig 148 can be likewise inverted to a second rest position with the second set of jig bearing points 172 resting upon support bearing points 80. The manner of placing a drill bit between jaws 14 and 15, and sharpening it, will be evident in view of the description of the embodiment of FIGS. 1–4. However, with regard to the embodiment of FIGS. 6–8, it should be noted that arms 150, 166, cannot be adjusted angularly with respect to their connected jaws. Thus, the lateral angle between clamp axis 22 and the first line extending between the first set of jig bearing points 156, and the lateral angle between clamp axis 22 and the second line extending between the second set of jig bearing points 172, cannot be adjusted.

Figure 10:
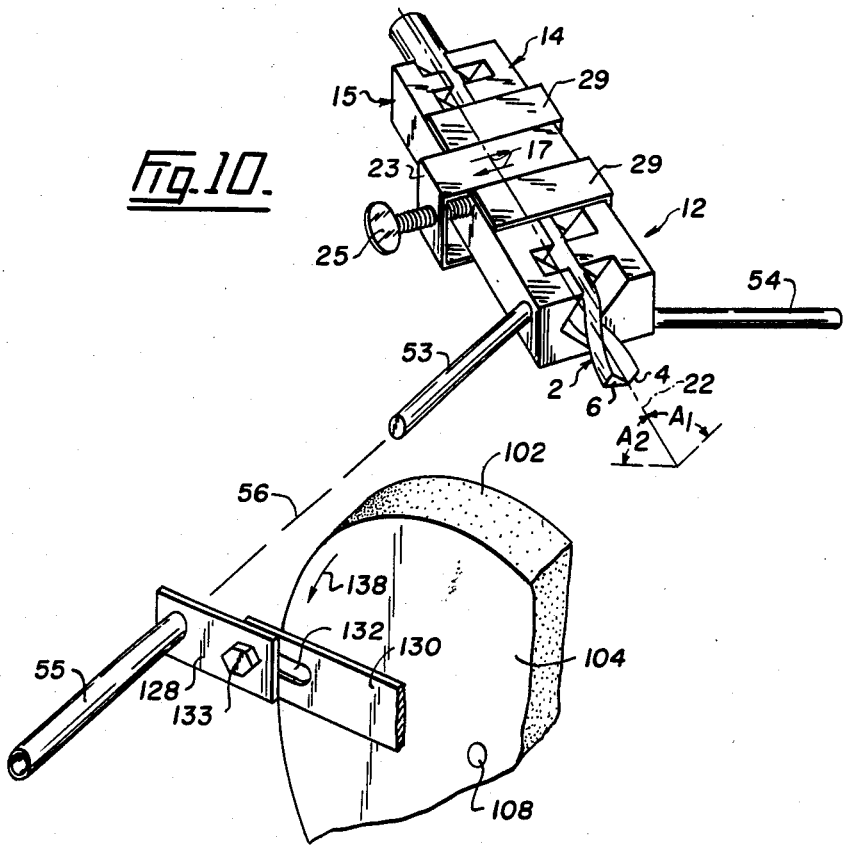
FIG. 10 is a perspective view of a preferred embodiment of the drill bit sharpening device of the present invention.
Figure 11:
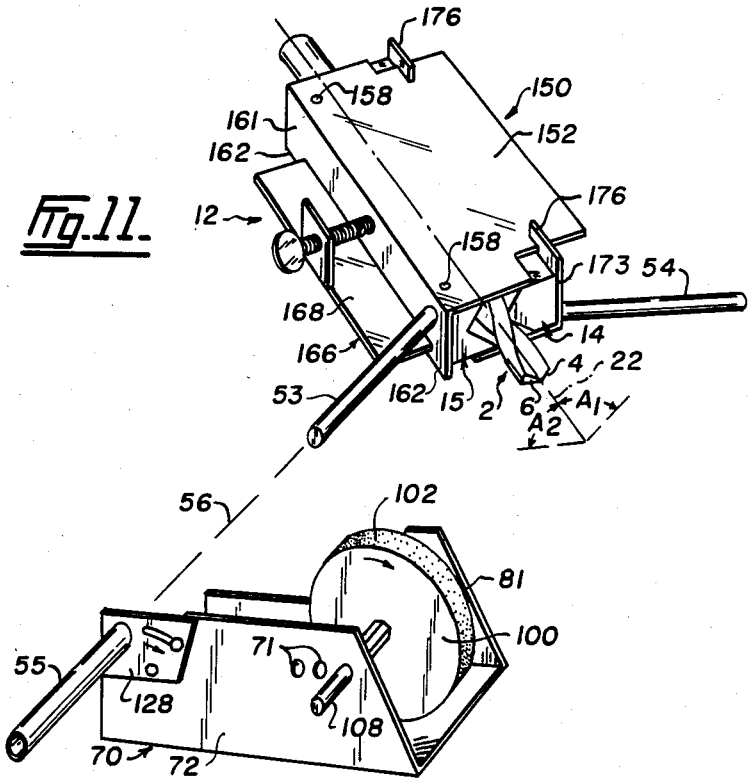
FIG. 11 is a perspective view of another preferred embodiment of the drill bit sharpening device of the present invention.

FIGS. 10 and 11 depict two preferred embodiments of the invention in which the jig pivot axis is provided by round shaft 53 joined to jaw 15 and round shaft 54 connected to jaw 14. Shaft 53 is sufficiently inserted along line 56 into sleeve 55 so that jig 12 is rotated downwardly drill bit face 4 of drill bit 2 makes contact with the grindstone surface 102. Similarly, jig 12 may be inverted and shaft 54 sufficiently inserted into sleeve 55 along line 56 to sharpen the second face 6 of drill bit 2.

In FIG. 10, sleeve 55 is attached to grindstone mount 130 by means of bracket 128. Adjusting bolt 134 slides in. Slot 132 to allow for adjustment of the pivot axis with respect to the grindstone surface 102. The method of releasing jaws 14 and 15 is similar to that described for FIGS. 1 to 4 where a bracket 23 connected to jaw 15 moves between guides 29 connected to jaw 14 in the direction of arrows 17.

In FIG. 11, sleeve 55 is attached to bracket 72 of grindstone support 70 by means of extension 128 and adjustment of the pivot axis with respect to the grindstone surface 102 is obtained by selecting one of the openings 71 in side 72 and rotation of extension 128. As disclosed in FIG. 6, jaw 15 is connected to arm 150 and jaw 14 is connected to arm 166 by means of screws, rivets, or the like passing through opening 158. Arms 150 and 166 are of a different shape than the arms shown in FIG. 6. First arm 150 has an upper panel 152 and a side panel 161 with tabs 162 extending downwardly retaining the narrow portion of the lower panel 168 of second arm 166. Similarly, side panel 173 of second arm 166 has two tabs 176 which extend upwardly retaining the narrowed portion of upper panel 152. Round shaft 53 is connected to side panel 161 of arm 150 and round shaft 54 is connected to side panel 173 of arm 166.

FIG. 12 is a view perpendicular to the drill bit axis of the embodiment shown in FIG. 11. This view depicts the distance D between the pivot axes defined by shafts 53 and 54 and the clamp axis 22. Also shown is another jaw arrangement in which alternately sloped teeth mesh to center the drill bit along the clamp axis.

The embodiments of all of the figures, are conveniently and economically constructed primarily of sheet metal, which can be bent and welded or soldered as required.

As will be apparent to those skilled in the art in light of the foregoing disclosure, many alterations and modifications are possible in the practice of this invention without departing from the spirit or scope thereof. Accordingly, the scope of the invention is to be construed in accordance with the substance defined by the following claims.

I claim:

1. A drill bit sharpening device, for use with a support carrying a rotatable grindstone and having pivot arm retaining means, the device comprising a drill bit jig having:

(a) clamp means for releasably retaining a drill bit therein in a position wherein the drill bit axis extends forward from the clamp means along a corresponding clamp axis;

(b) a first and second jig pivot arm connected to said clamp means symmetrically located about the axis of a drill bit held in the clamp such that if the clamp means is rotated 180° about its axis said arms will assume identical and diametrically opposed positions;

(c) said pivot arms being located such that the first pivot arm can rest in a pivot arm retaining means with the axis of the drill bit held in the clamp extending forward to intersect a grinding face of said grindstone carried in said support at a predetermined angle $A_1$ thereto, and in an inverted clamp position the second arm can rest in a pivot arm retaining means, with the axis of the drill bit held in the clamp extending forwardly to intersect the same grinding face at an identical point of intersection on the drill bit axis and at an equal angle $A_2$.

2. A drill bit sharpening device as described in claim 1 wherein each of the first and second jig pivot arms, comprises two bearing points disposed such that the lateral angle between the clamp axis and a first line extending between the points of the first pivot arm and the clamp axis, is equal but opposite to the lateral angle between the clamp axis and a second line extending between the points of the second pivot arm, so that when the jig is in the first or second rest position, the first or second jig pivot arms rest on the same pivot arm retaining means.

3. A drill bit sharpening device as described in claim 2 wherein the jig bearing points allow the jig to pivot about a jig pivot axis in a vertical direction perpendicular to the clamp axis when the jig is in the first or second rest position.

4. A drill bit sharpening device as described in claim 2, wherein the frame has first and second jig pivot arms, and wherein the clamp means comprises:

(a) two opposed jaws each attached to a corresponding arm, and movable toward and away from one another while moving their respective arms with them, so as to accommodate different diameter drill bits therebetween while maintaining a symmetrical relationship between the clamp axis and the axes of the first and second jig pivot arm; and (b) a jaw adjuster connected to the jaws, and which can urge them toward and away from one another to retain a drill bit therebetween.

5. A drill bit sharpening device as described in claim 4, wherein each of the jig pivot arms is adjustable with respect to its corresponding jaw, so that the angles between the axis of the first arm and the clamp axis, and between the axis of the second arm and the clamp axis, can be releasably fixed in any of a plurality of equal but opposite values.

6. A drill bit sharpening device as described in claim 1 wherein the first and second jig pivot arms, comprise a first and second shaft disposed such that the lateral angle between the clamp axis and a first axis extending along said first shaft, is equal but opposite to the lateral angle between the clamp axis and a second axis extending along said second shaft, so that when the jig is in the first or second rest position, the first or second jig pivot arm rests on the same pivot arm retaining means.

7. A drill bit sharpening device as described in claim 6, wherein said pivot arm retaining means, comprises a sleeve disposed on said support carrying rotatable grindstone, such that an axis extending along said sleeve is parallel to the rotational axis of said grindstone allowing said jig to pivot about said sleeve when the jig is in the first or second rest position.

8. A drill bit sharpening device as described in claim 7, wherein the clamp means comprises:

two opposed jaws each attached to a corresponding shaft, and movable toward and away from one another while moving the respective shaft with them, so as to accommodate different diameter drill bits therebetween while maintaining a constant angle between the clamp axis and the first and second axes extending along said first and second shafts; and a jaw adjuster connected to the jaws, and which can urge them toward and away from one another to retain a drill bit therebetween.

9. A drill bit sharpening device as described in claim 7, wherein the clamp means comprises:

two opposed jaws movable toward and away from one another so as to accommodate different diameter drill bits therebetween while maintaining a constant angle between the clamp axis and the first and second axis of said first and second shafts; and a jaw adjuster having a first and second jaw retaining member connected to the jaws, and which can urge them toward and away from one another to retain a drill bit therebetween, said first and second jaw retaining members being connected to said first and second shafts.

10. A drill bit sharpening device as described in claim 9, wherein said support has a grindstone mount to rotatably support a circular grindstone at a grindstone axis laterally spaced from the jig pivot axis, so that a drill bit held in the clamp means can have each of its cutting edges sharpened at the same predetermined angle to the clamp axes, and the material behind its cutting edge sloped rearward from the cutting edges in a backsweep arc by pivoting the jig above the jig pivot axis.

11. A drill bit sharpening device as described in claim 10 wherein the jig pivot arms and pivot arm retaining means are disposed so that each of the angles $A_1$ and $A_2$ are 59°, and wherein the angle between the clamp axes and the jig pivot axes in such that when a grindstone is supported in the grindstone mount, the material behind each cutting edge of a drill bit held in the clamp means can be cut in a rearward convex slope at a fixed angle of from substantially 8° to 12° adjacent the cutting edge in a rearward arc of substantially 0.7 inches radius, by pivoting said jig about said jig pivot axis.

12. A drill bit sharpening device as described in claim 10, additionally comprising a circular grindstone supported in the grindstone mount.

13. A drill bit sharpening device comprising:

(a) a support adapted to receive a rotatable grindstone, and having pivot arm retaining means;

(b) a drill bit jig having:

(i) clamp means for releasably retaining a drill bit therein in a position wherein the drill bit axis extends forward from the clamp means along a corresponding clamp axis;

(ii) a first and second jig pivot arm connected to said clamp means symmetrically located about the axis of a drill bit held in the clamp such that if the clamp means is rotated 180° about its axis said arms will assume identical and diametrically opposed positions;

(iii) said pivot arms being located such that the first pivot arm can rest in a pivot arm retaining means with the axis of the drill bit held in the clamp extending forward to intersect a grinding face of said grindstone carried in said support at a predetermined angle $A_1$ thereto, and in an inverted clamp position the second arm can rest in a pivot arm retaining means, with the axis of the drill bit held in the clamp extending forwardly to intersect the same grinding face at an identical point of intersection on the drill bit axis and at an equal angle $A_2$, the jig pivot arm and the pivot arm retaining means being dimensioned to prevent the jig from pivoting sideways in relation to the clamp axis, when the jig is in the first and second rest position.

14. A drill bit sharpening device as described in claim 13 wherein each of the first and second jig pivot arms, comprises two bearing points disposed such that the lateral angle between the clamp axis and a first line extending between the points of the first pivot arm and the clamp axis, is equal but opposite to the lateral angle between the clamp axis and a second line extending between the points of the second pivot arm, so that when the jig is in the first or second rest position, the first or second jig pivot arms rest on the same pivot arm retaining means.

15. A drill bit sharpening device as described in claim 14, wherein the frame has first and second jig pivot arms, and wherein the clamp means comprises:

(a) two opposed jaws each attached to a corresponding arm, and movable toward and away from one another while moving their respective arms with them, so as to accommodate different diameter drill bits therebetween while maintaining a symmetrical relationship between the clamp axis and the axes of the first and second jig pivot arms; and (b) a jaw adjuster connected to the jaws, and which can urge them toward and away from one another to retain a drill bit therebetween.

16. A drill bit sharpening device as described in claim 15, wherein each of the jig pivot arms is adjustable with respect to its corresponding jaw, so that the angles between the axis of the first arm and the clamp axis, and between the axis of the second arm and the clamp axis, can be releasably fixed in any of a plurality of equal but opposite values.

17. A drill bit sharpening device as described in claim 15 wherein the jig pivot arms and the jig pivot retaining means of the support allow the jig to pivot about a jig pivot axis in a vertical direction perpendicular to the clamp axis, when the jig is in the first or second rest position.

18. A drill bit sharpening device as described in claim 17, additionally comprising a circular grindstone supported in the grindstone mount.

19. A drill bit sharpening device as described in claim 14 wherein the jig pivot arms and the pivot arm retaining means, allow the jig to pivot about a jig pivot axis in a vertical direction perpendicular to the clamp axis, when the jig is in the first or second rest position.

20. A drill bit sharpening device as described in claim 19, wherein the clamp axis is vertically spaced from the jig pivot axis, and wherein said support has a grindstone mount to rotatably support a circular grindstone at a grindstone axis laterally spaced from the jig pivot axis, so that a drill bit held in the clamp means can have each of its cutting edges sharpened at the same predetermined angle to the clamp axis, and the material behind its cutting edge sloped rearward from the cutting edges in a backsweep arc by pivoting the jig in the vertical direction about the jig pivot axis.

21. A drill bit sharpening device as described in claim 20 wherein the jig pivot arms and the jig pivot retaining means of the support are disposed so that each of the angles $A_1$ and $A_2$ are 59°, and wherein the vertical spacing between the clamp axis and the jig pivot axis is such that when a grindstone is supported in the grindstone mount, the material behind each cutting edge of a drill bit held in the clamp means can be cut in a rearward convex slope at a fixed angle of from substantially 8° to 12° adjacent the cutting edge in a rearward arc of substantially 0.7 inches radius, by pivoting said jig in the vertical direction.

22. A drill bit sharpening device as described in claim 20, additionally comprising a circular grindstone supported in the grindstone mount.

23. A drill bit sharpening device as described in claim 13 wherein each of said first and second jig pivot arms, comprises a first and second shaft disposed such that the lateral angle between the clamp axis and a first axis extending along said first shaft is equal but opposite to the lateral angle between the clamp axis and a second axis extending along said second shaft, so that when the jig is in the first or second rest position, the first or second jig pivot arm rests on the same pivot arm retaining means.

24. A drill bit sharpening device as described in claim 13 wherein said pivot arm retaining means, comprises a sleeve disposed on said support carrying a rotatable grindstone such that an axis extending along said sleeve is parallel to the rotational axis of said grindstone allowing said jig to pivot about said sleeve when the jig is in the first or second rest position.

* * * * *